METHOD AND A CIRCULAR KNITTING MACHINE FOR MANUFACTURING STOCKINGS AND LIKE ARTICLES HAVING A JACQUARD PATTERN OVER RIBBED KNITWORK MADE OF PLAIN AND PURL STITCHES

BACKGROUND OF THE INVENTION

This invention relates to a method of manufacturing stockings and like articles having a Jacquard pattern over ribbed knitwork made of plain and purl stiches, as well as to a circular knitting machine carrying to effect such a method.

The prior art stockings, socks, hoses and similar, of the type having a Jacquard pattern over ribbed knitwork, have been produced on double cylinder circular knitting machines. As known, the knitting process is carried out with at least two thread feeds, and by knitting with the needles parting in the upper needle cylinder and partly in the lower one. More specifically, the leg portion is advantageously knitted with the needles alternatively in one needle cylinder and the other, thereby all the upper cylinder needles pick up the thread from each feed at every knitting course, whereas the lower cylinder needles pick up the thread each from one feed only during a knitting course according to the pattern to be obtained. On completion of the leg portion, part of the upper cylinder needles hold the knitwork while the rest of the needles are transferred into the lower needle cylinder, wherein they all cooperate to form the heel portion of the stocking or like articles. The corresponding needles are then returned to the upper needle cylinder and the foot portion is knitted in a manner substantially similar to the leg portion knitting step. The toe, when not directly closed on the machine by any known method, may be left open and knitted like a heel, whereby a new transfer and knitting step is effected as described hereinabove, the toe being then closed by sewing.

Such machines permit wide variations in the pattern and provide highly satisfactory products. However, they are not entirely free from drawbacks, which are generally considered unimportant when compared to the aforementioned capabilities, and thus tolerated.

The shortcomings reside mainly in the high cost of such double cylinder circular knitting machines, their bulk, and especially their height, the need for qualified personnel both for their operation and adjusting, and their comparatively limited production rate. The latter is indeed limited by such factors as the complexity and fragility of the machine, which permit no rotation or reciprocation of the needle cylinders at a very high speed, and by the need of transferring of the needles from one needle cylinder to the other, which is a frequently repeated step during the knitting of a stocking and like article, thus bringing about operational times which are inefficient from the knitwork production point of view. Indeed, the transfer movement requires each time that the needle be unhooked from the respective transfer slider or jack in one needle cylinder and hooked by the corresponding transfer slider in the other needle cylinder, in addition to the transferring of the needle proper.

SUMMARY OF THE INVENTION

It is primary object of the prsent invention to overcome the aforementioned problems and limitations by providing a method and a circular knitting machine for manufacturing stockings and like articles which, while retaining the positive features of the prior art machines for what concerns the variety of the feasible patterns and the technical quality of the product, ensure a larger production rate with extreme reliability and for a lesser constructional complexity, the machine being also more compact and requiring no qualified personnel for operation and adjustment.

This object is achieved by a method of manufacturing stockings and like articles having Jacquard pattern over ribbed knitwork made of plain and purl stitches, the method making use of at least two different thread feeds and of needles arranged on two distinct supporting structures which rotate in timed relationship, and comprising at least one knitting step wherein the needles of one of said structures pick up the thread from each feed during one course of knitting and the needles of the other of said structures, arranged between the needle of said one structure, pick up the thread each from one feed for every course of knitting, and at least one heel knitting step including reciprocation of said support structures wherein a portion of the knitwork is retained by a corresponding part of the needles of said one structure and a heel portion is knitted by all the needles of said other structure which all pick up the thread from the same feed during reciprocation of said support structures, the method being characterized in that just prior to the knitting of the heel portion part of the needles of said one structure are controlled to pass the loops to underlying needles of said other structure and are held inoperative in said one structure during the entire heel knitting step, and in that after knitting the heel portion such needles are held inoperative and at least one length of the foot portion is knitted with the remaining needles of said one structure in cooperation with the needles of said other structure.

In order to carry out the inventive method, the invention provides a circular knitting machine for stockings and like articles having at least two different thread feeds and needles arranged on two distinct support structures rotating in timed relationship, and means for reciprocating said two support structures, the machine being characterized in that the first one of said two structures comprises a needle dial, known per se, including radial needles which are one half in number as the needles in the second of said support structures which comprises a needle cylinder, known per se, having axial needles, and in that means are provided for simultaneously and selectively controlling to an operative position at least part of the needles of the needle dial and the corresponding underlying needles of the needle cylinder in order to pass the loops from part of the needle of said needle dial to the corresponding underlying needles of the needle cylinder just prior to said reciprocation.

A method and machine according to the invention accomplish simultaneously a Jacquard pattern and a ribbed knitwork on a single cylinder knitting machine, which results, as known, in a higher production rate since the machine may be operated at higher speeds than a double cylinder knitting machine. With the loop transfer process according to the invention, in lieu of the prior art needle transfer, a simplified construction becomes feasible thanks to the fact that the transfer sliders or jacks and related control means for the unhooking and hooking of the needles are no longer necessary, while the dead time involved in the needle transfer step is effectively eliminated. The elimination of the upper needle cylinder allows, moreover, a noteworthy reduction in the physical dimensions of the machine.

BRIEF DESCRIPTION OF THE DRAWINGS

Further features and advantages of the invention will become apparent from the following description of a preferred embodiment of a method and machine according to the invention, provided by way of example and illustrated in te accompanying drawings, where.

DESCRIPTION OF THE PREFERRED EMBODIMENTS

Figure 2:
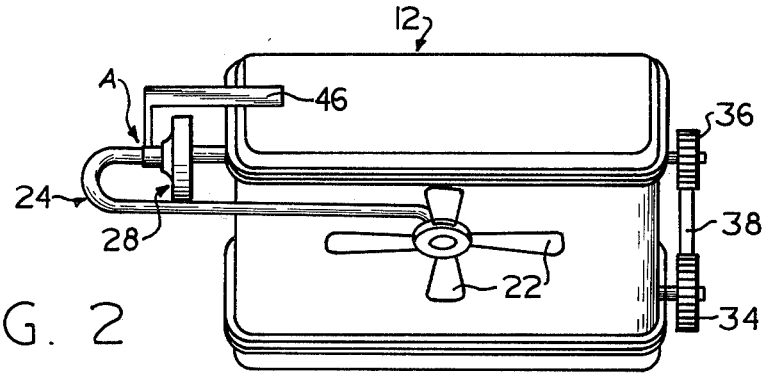
FIG. 2 is a top plan view, to a slightly smaller scale, of the control means for the needles of the needle dial.

The machine carrying out the inventive method comprises a needle cylinder 1 acting as a supporting structure for needles 2, which are movable axially within grooves of the cylinder 1 and driven by selectors 3, activated in a known manner by selecting levers 4 under control by the machine program.

The machine also comprises a needle dial 5 acting as a supporting structure for needles 6, which are movable within radial grooves in the dial 5. The latter is supported rotatably by a stationary structure 7 and driven into rotation by a shaft 8 in timed relationship with the needle cylinder 1 through gear means, not shown.

A disc 19 is supported fixedly by the stationary structure 7 which defines the control means of the needles in the needle dial. More specifically, the disc 9 is provided with fixed cams defining a continuous groove 10 (FIG. 2) wherein the butts 11 of the dial needles 6 are allowed to move as the needle dial 5 rotates with respect to the stationary disc 9. The groove 10 has inner groove portions 10*a* and outer groove portions 10*b* corresponding, respectively, to an inoperative position and an operative position of the needles 6. In FIG. 2, there are denoted with I and II, in diagramatic form, two discrete thread feeds, although it should be understood that the feeds may be higher in number, in which instance the cam 10 would be configurated accordingly such as to permit the needles 6 to move outwardly and pick up the thread from the additional feeds as well.

Figure 3:
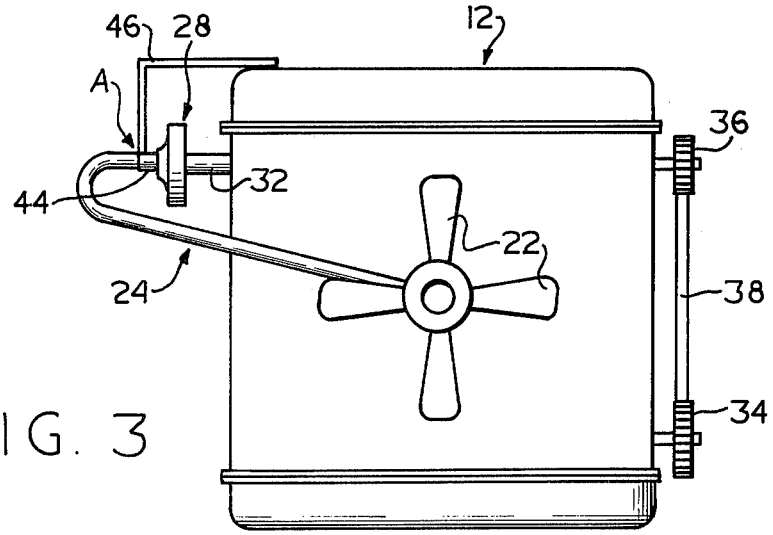
FIG. 3 is a detail view of the selecting means for the needles of the needle dial.

The means for selecting the needles of the needle dial include movable cams in form of selecting plungers 12 (FIG. 3), which are movable vertically within a guide cylinder 13, attached to a supporting surface 13*a*, and subjected to the elastic action of a spring 14 biasing the plungers 12 downwards into corresponding portions of the cam 10. Each plunger 12 is driven by a drive or conrol lever 15, movable within two windows 16 of the guide cylinder 13 perpendicularly thereto as shown by the arrowheads and engaging with a tooth 17 formed integral to each plunger 12. The lever 15 has steps 18 with interconnecting portions or lengths, and engages with the tooth 17 such as to provide for the plunger 12 at least one position inside the cam 10 and a position outside of the cam. The activation of the lever 15 is dependent on the machine program, as described hereinafter.

The machine includes three such plungers 12, shown schematically in FIG. 2 and located at the dividing point at which portions 10*b* depart from portions 10*a*. Two such plungers are located upstream of a respective feed, and the third is located upstream of a withdrawal portion 10*c* of the cam 10, between the two feeds at a non-knitting area. Most advantageously, the plungers are also provided with a position intermediate to said two positions, and the corresponding drive or control lever 15 is formed with three steps such as to provide three different height positions for the plunger, one whereof is shown in full lines in FIG. 3, the other two being shown in dotted lines.

The needles 6 of the needle dial 5, as best shown in FIGS. 5*a* to 5*e* and 10, are provided in a number equal to one half the number of the needles 2 of the needle cylinder 1, such that for each needle of the dial three corresponds an underlying needle of the needle cylinder. The butts 11 of the needles 6 of the dial are of at least two heights, such that the needles with the higher butt are engaged by the plunger 12, arranged at the withdrawal portion 10*c*, when at the intermediate position, whereas the needles with the lower butt are not engaged thereby. Each plunger, at its outermost position, obviously does not engage any butt, but does engage the totality of the butts when at its innermost position with respect to the cam 10. Most advantageously, the heights of the butts 11 and the positions of the plungers 12 may be in greater number, for example four, in order to achieve a wider selection range and, accordingly, a greater knitting variety.

The remaining machine components, and particularly those effective to produce the reciprocating motion, are of conventional design.

Figures 1, 2, 4:
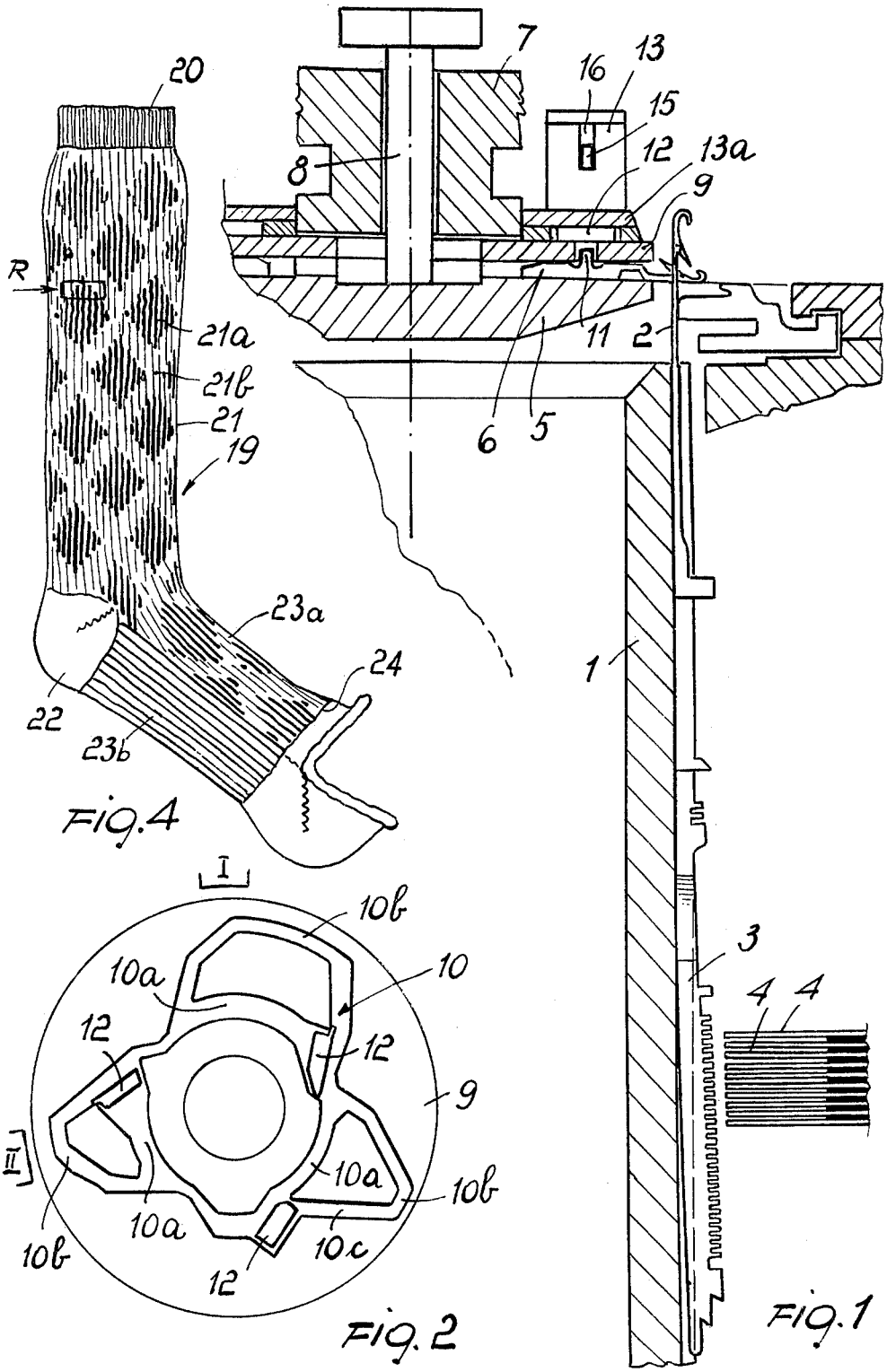
FIG. 1 is a partial axial section view through the machine according to the invention.
FIG. 4 shows a sample of a stocking article as obtainable with the method and machine of the invention.
Figure 3:
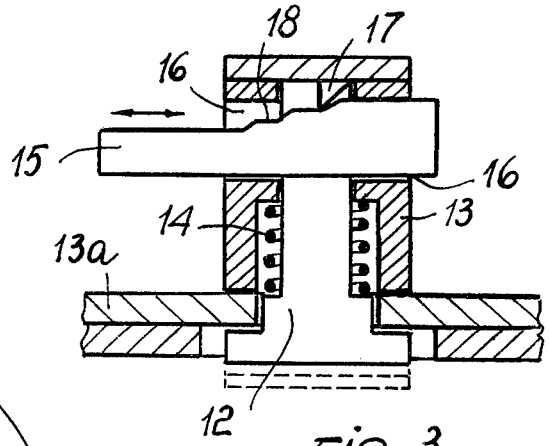

The knitting of a stocking article, such as the stocking 19 shown by way of example in FIG. 4, is performed in the following manner.

The initial elastic portion 20 may be formed in any known manner, and is thus omitted from the present description.

The leg portion 21, comprised on the front or right side of, for example, a two-color pattern with squares 21*a* of one color and intervening lengths 21*b* of another color, is formed, e.g. with two feeds, one whereof, the feed I, supplies the thread for the lengths 21*b* and the other, the feed II, supplies the thread for the lengths 21*a*. In knitting one course, all the needles 6 of the dial 5 pick up the thread from both the feed I and II. The cylinder needles intervening between the dial needles, pick up the thread during that same course from one feed only, excepting the needles underlying the dial needles, which pick up no thread at all. This is illustrated schematically and by way of example in FIGS. 5*a* and 5*b*, where in FIG. 5*a* two cylinder needles 2*a* only, intervening between dial needles, have picked up the thread from the feed I (shown in full lines), whereas in FIG. 5*b* the thread from the feed II (shown in dotted lines) has been picked up by those needles 2*b* of the needle cylinder which have not picked up the thread from the feed I, all the needles 2*c* underlying the dial needles 6 having been held inoperative. In fact, as the needles pick up the thread from the feed II, the needles which have picked up the thread from the feed I are lowered with the thus picked up thread, and the situation is as shown schematically in FIG. 5*c*.

Figure 5A:
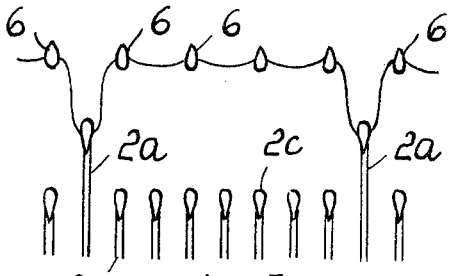
FIGS. 5*a*, 5*b*, 5*c*, 5*d* and 5*e* show respectively in schematic forms the operation of the needles in knitting two adjacent courses of the leg portion of the stocking.
Figure 5B:
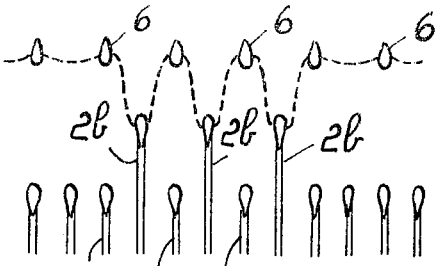
Figure 5C:
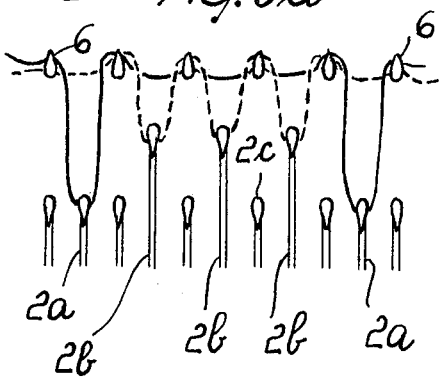
Figure 5:
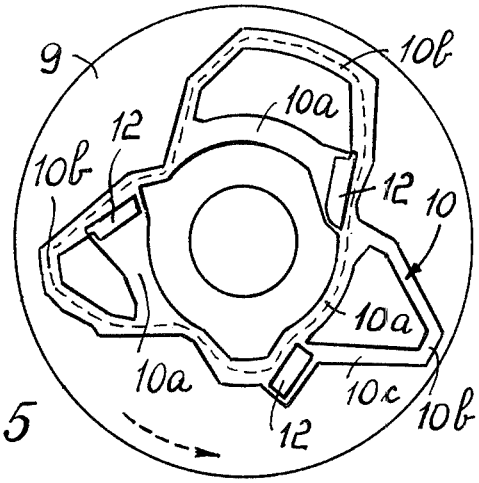
FIG. 5 shows the control means for the needles of the needle dial and the path followed by these needles during the knitting of the leg portion of the stocking and like article.
Figure 5D:
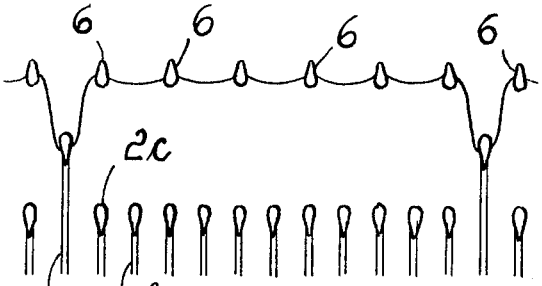
Figure 5E:
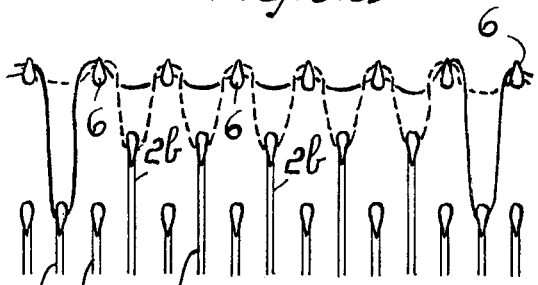

During this step, the plungers 12 are all fully depressed and all the needle butts 11 follow the pattern shown in dotted lines in FIG. 5, since all the needles 6 are involved in the knitting process. The dotted arrowhead in FIG. 5 shows the direction of rotation of the dial 5 with respect to the stationary disc 9. The selection of the cylinder needles 2 is rather effected with the selecting levers 4 such that only the needles 2*a* and 2*b* intervening between the dial needles 6 are lifted, and each of them at one feed only according to the pattern to be obtained.

For the next knitting course, as well as for the rest of the leg portion 21, the operation is similar, with the exception that the number varies of the cylinder needles which pick up each time the thread from a given feed. For example, it is assumed in FIGS. 5*d* and 5*e* that, in the course following the one considered in FIGS 5*a* to 5*c*, the needles which pick up the thread from the feed II are now five instead of three since, as the square 21*a* is widened as shown by the rectangle R in FIG. 4, the two outer needles which had formerly picked up the thread from the feed I and knitted the length 21*b* are now knitting the length 21*a*. It will appear that the selection of the cylinder needles according to the desired pattern is performed by conventional means.

Figure 6:
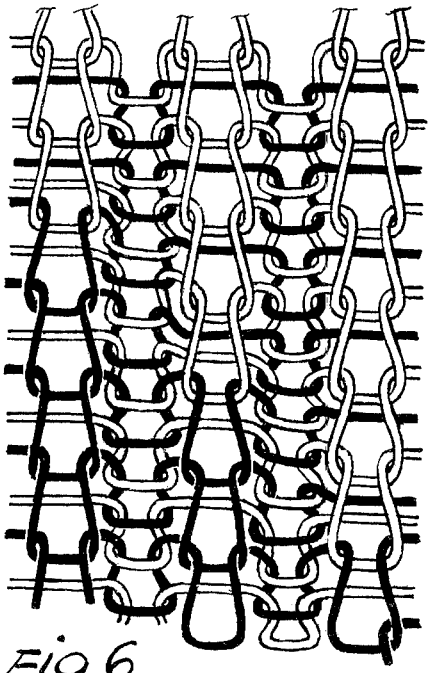
FIG. 6 shows a sample of the resulting knitwork.

In FIG. 6, a knitted length can be seen which has been obtained as described hereinabove, i.e. with a pattern and ribbed knitwork.

Figure 7:
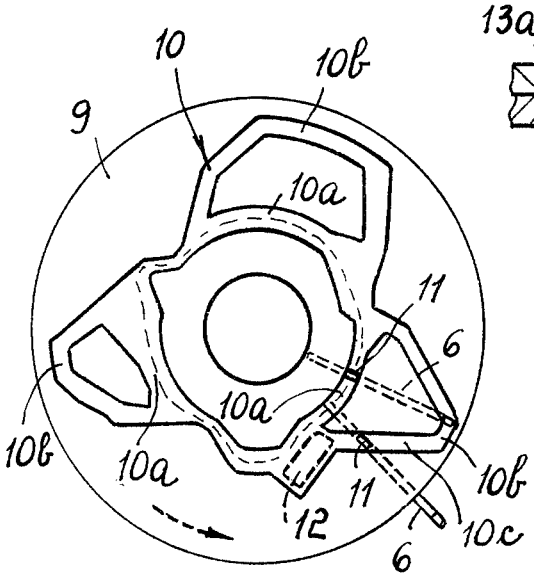
FIG. 7 shows the control means for the needles of the needle dial, with the path followed by these needles during the transition from the leg portion knitting to the heel portion knitting.
Figure 8:
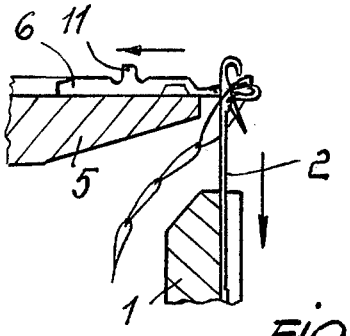
FIG. 8 shows schematically the loop transfer step prior to the formation of the heel portion.

The termination of the leg portion and the start of the heel portion 22 are next discussed. Part of the dial needles 6, approximately one half thereof and specifically the needles having the higher butts 11, are controlled to retain the loops of the last formed course, while the rest of the needles 6, having lower butts, are controlled to pass the loops to the correspondingly underlying cylinder needles 2*c*, which are in turn lifted to take them up. To this end, the plungers 12 located upstream of the respective feeds I and II are fully lifted and the third plunger is instead brought to its intermediate position and is shown in dotted lines in FIG. 7. The actuation is effected under control by the machine program through the respective drive or control levers 15. In this condition, the needles 6 with the higher butts are re-directed toward the innermost portion 10*a* of the cam 10 (FIG. 7) and brought to an inoperative position whereat they retain the knitwork loops. The needles 6 provided with the lower butts are not influenced by the intermediate position plunger and move onward along the withdrawal portion 10*c* (FIG. 7) and are brought to a withdrawn position whereat they pass the loops to the correspondingly underlying cylinder needles 2*c* (FIG. 8), at the same time caused to lift. Subsequently, the needles of the dial and of the cylinder which have carried out the loop transfer are retracted as indicated by the arrowheads in FIG. 8 and, after all the needles 6 with the lower butts have completed the transfer, the corresponding plunger 12 is fully depressed and brought to its lowermost position within the cam 10. All the dial needles follow now the innermost path (FIG. 9) and are at an inoperative position. Part of the needles retain the loops, the rest being free of the loops.

Figure 10:
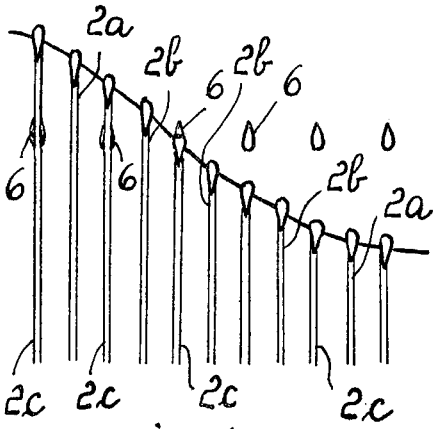
FIG. 10 shows schematically how the heel portion is formed by operating all the cylinder needles.
Figure 9:
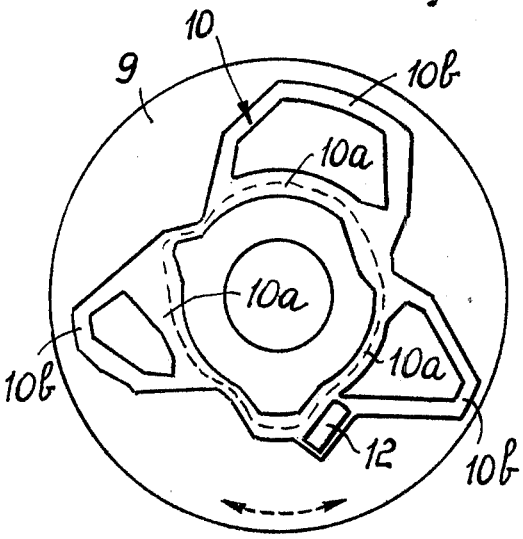
FIG. 9 shows the control means for the needles of the needle dial and the path followed by these needles during the heel portion knitting step.

At this stage, the knitting of the heel portion 22 begins by means of all the cylinder needles 2*a*, 2*b* and 2*c*, which all pick up the thread from one feed, e.g. feed I, as shown schematically in FIG. 10. The heel portion is knitted by reciprocating the needle cylinder through conventional means, which are not described and shown. During the reciprocation of the dial, all the needles thereof move along the innermost track, as shown in FIG. 9, whre the dotted line double arrowhead indicates the dial movement with respect to the stationary disc 9.

On completion of the heel portion 22, all the plungers 12 are brought to an intermediate position (shown in dotted lines in FIG. 3), and the dial needles with the higher butts, which had retained the loops, are controlled to resume the knitting with the thread from both feeds. The needles with the shorter butts are no longer operative, and follow the path shown in dotted lines in FIG. 9. The cylinder needles are driven in conformity with the type of knitwork to be obtained. Most advantageously, one half the needles 2*a* and 2*b* may operate in cooperation with the needles 11 having thelonger butts, to produce the upper part 23*a* of the foot portion, e.g. by carrying on the same pattern as knitted in the leg portion, while the other half of the needles 2*a* and 2*b* may knit, together with the intervening needles 2*c*, the lower part 23*b* of the foot portion, to any desired pattern.

On completion of the foot portion, at the course 23*c*, a loop transfer takes place from the needles 11 having the longer butts to the correspondingly underlying cylinder needles 2*C*. The knitting is then carried on with all and only the cylinder needles, thereby the stocking article knitting is terminated by methods known per se.

It will be seen that, with the method and machine according to the invention, it becomes possible to produce socks, stockings, hoses and the like knitted articles, simultaneously with a Jacquard pattern and a ribbed knitwork having plain and purl stiches, without involving any transfer of theneedles and the hooking and unhooking thereof to and from specially provided transfer means at any steps of the knitting process. In practicing the invention, all the needles perform exclusively those axial movements as are contemplated for the formation of the knitwork. The controls to actuate in passing from the leg portion knitting step to the heel portion knitting step, and from the latter to the knitting of the foot portion, are exclusively those related to the axial movement or displacement of the levers 15 for controlling or driving the needles 6 and those related to the simultaneous selection of the needles 2*c* for the lifting thereof, as well as the activation and disactivation of the reciprocating motion of the needle cylinder and needle dial, i.e. controls and drives which may be easily and quickly provided. The machine for carrying out the inventive method offers all the advantages of a single cylinder knitting machine.

I claim:

1. A circular knitting machine for manufacturing stockings and like articles having a jacquard pattern over ribbed knitwork made of plain and purl stitches, comprising at least two different thread feeds, e.g. of different colors, a needle dial and a needle cylinder rotating in timed relationship and having needles movable thereon, the needles of the needle dial being one half in number as the needles of the needle cylinder, means for reciprocating said needle dial and needle cylinder, means for independently selecting the needles of the needle dial and of the needle cylinder to knit at a corresponding thread feed, means for simultaneously and selectively controlling at least part of the needles of said needle dial and the corresponding underlying needles of the needle cylinder for transferring the loops from said part of the dial needles to the corresponding underlying cylinder needles, wherein said needles of the needle dial have butts of at least two different heights and are grouped in at least two groups each comprising the dial needles having a same butt height, and wherein said means for selecting the needles of the needle dial comprise a stationary disc located over the needle dial and provided with cams defining a path for the butts of the needles of the needle dial, said cams comprising fixed cams defining an inner continuous groove portion for the butts and outer groove portions at each feed area departing from said inner groove portion and returning therein to cause the dial needles to radially project for taking up the thread at the corresponding thread feed and an additional outer groove portion at a point between two feeds at a non-knitting area for causing selected dial needles to outwardly project for trasferring loops to corresponding cylinder needles, and a vertically movable cam at each zone of departure of said outer groove portions from said inner groove portion, said movable cams being movable between a position external to said groove portions and a position fully internal thereto and the movable cam provided at the departure of said additional outer groove portion being further movable into at least one position intermediate between the position external to said groove portions and the position completely internal thereto to cause dial needle selection for loop transfer according to the butt height of the dial needles.

* * * * *